United States Patent [19]

Blanchard

[11] Patent Number: 4,901,894

[45] Date of Patent: Feb. 20, 1990

[54] SNAP ON AUXILIARY BAR FOR HANGERS

[75] Inventor: Russell O. Blanchard, Zeeland, Mich.

[73] Assignee: Batts, Inc., Zeeland, Mich.

[21] Appl. No.: 222,789

[22] Filed: Jul. 22, 1988

[51] Int. Cl.[4] ..... A47G 25/48

[52] U.S. Cl. ..... 223/96

[58] Field of Search ..... 223/91, 93, 96; 211/45, 211/113; D6/315, 326, 327

[56] References Cited

U.S. PATENT DOCUMENTS

| | | | |
|---|---|---|---|
| D. 222,513 | 10/1971 | Hart et al. | D6/315 |
| D. 224,670 | 8/1972 | Hart | D6/327 |
| D. 225,151 | 11/1972 | Hart | D6/326 |
| 2,822,967 | 2/1958 | Spitz | D6/326 X |
| 2,970,726 | 2/1961 | Brooke | 223/96 |
| 3,157,325 | 11/1964 | Schaefer | 223/91 |
| 3,165,245 | 1/1965 | Levine et al. | 223/91 |
| 3,350,754 | 11/1967 | Ballenger et al. | 223/96 X |
| 3,471,069 | 10/1969 | Simon | 223/91 |
| 3,744,685 | 7/1973 | Hart | 223/96 |
| 3,767,092 | 10/1973 | Garrison et al. | 223/96 |
| 4,759,480 | 7/1988 | Duester et al. | 223/96 |

*Primary Examiner*—Werner H. Schroeder
*Assistant Examiner*—David K. Suto
*Attorney, Agent, or Firm*—Price, Heneveld, Cooper, DeWitt & Litton

[57] ABSTRACT

For a garment hanger having a rigid, elongated body equipped with garment clamps at each end, an accessory garment support bar is provided having a garment holding portion longer than the spacing between the clamps, which bar is detachably connected to the hanger body inward of the clamps which supports the bar rearwardly of the plane assumed by a garment suspended from the clamps.

11 Claims, 2 Drawing Sheets

SNAP ON AUXILIARY BAR FOR HANGERS

SUMMARY OF THE INVENTION

An auxiliary bar over which articles, such as pants or slacks, can be draped has a detachable connection to a conventional clamping hanger such that it can be added to or removed from the hanger and, when not in use, can be stored until needed. In most cases, the means of anchoring the bar tot he hanger does not require modification of the hanger.

BACKGROUND OF THE INVENTION

An article clamping hanger, such as the hanger disclosed in U.S. Pat. No. 3,767,092, entitled GARMENT CLAMPING HANGER WITH SLIDABLE LOCKING CLIP, issued Oct. 23, 1973, to Garrison et al. is a typical hanger to which this invention can be applied. Hangers having this construction are widely used, not only for the display of garments but also for the display of other articles of merchandise such as towels and similar articles. However, the greatest use of hangers of this type is for the display of clothing such as pants and slacks. Under certain circumstances, it is desirable that the article, such as a pair of pants, not hang down for its full length. Such garments must be supported at a high enough level that they will not contact the floor. Under other circumstances, it is desirable to display the garment partially folded so that it can be displayed in association with other garments to provide a coordinated display. In the past, this has been accomplished by modifying the clamping hangers by the addition of a bar over which the pants or slacks, for example, can be partially folded or draped. To do this, the hangers have been equipped with a wire auxiliary bar which is secured to the rear jaw of the clamps. An alternative to this has been the molding of the clamps with an integral bar which depends from the rear jaw and is positioned below the main body of the hanger. In this latter case, the bar being integral with the hanger, is a permanent part of the hanger and thus is always present, even under circumstances in which its presence is not desired. In the case of the wire auxiliary bar, this can be made detachable but it requires the hanger to be specially designed to connect the bar. In some cases, a molded plastic auxiliary bar has been substituted for the wire one but, again, it has been necessary to modify the hanger to secure the auxiliary bar. Thus, in all cases, the hanger has to be specially designed and manufactured to adapt it to use of the auxiliary bar. This restricts the use of the auxiliary bar to a very limited number of hangers.

BRIEF DESCRIPTION OF THIS INVENTION

This invention provides an auxiliary bar which can be so constructed that it can be detachably secured to a clamping hanger of the presently existing construction which has not been specifically designed to secure it. Furthermore, the invention provides an auxiliary bar so designed that it can be quickly and easily mounted on or removed from the hanger, permitting the hanger to be used in its original condition or modified when needed and returned to its original condition when the auxiliary bar is no longer necessary. Further, the attachment and removal of the auxiliary bar is rapid and uncomplicated and requires no tools and no special instructions.

DESCRIPTION OF THE PREFERRED EMBODIMENT

Figure 1:
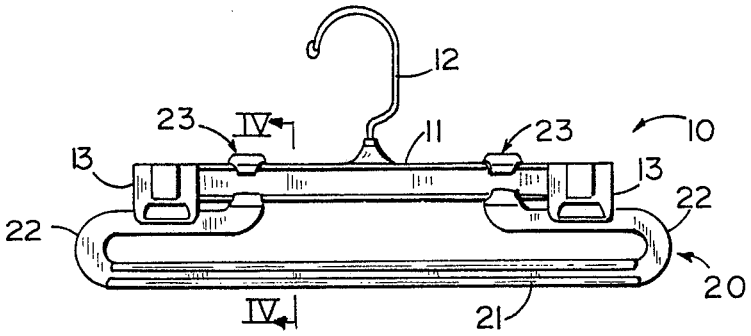
FIG. 1 is a front elevational view of a garment clamping hanger equipped with this invention.

Referring to FIG. 1, the numeral 10 identifies a conventional garment clamping hanger having an elongated body 11 supported at its center by a hook 12 and equipped at each end with a garment clamp 13. This hanger is one of the type described in U.S. Pat. No. 3,767,092, issued Oct. 23, 1973 to J. F. Garrison et al. The invention provides an auxiliary bar 20 which is designed to be detachably secured to the hanger body 10. The auxiliary bar has an article supporting, transverse member 21 which terminates in a pair of reversely bent end portions 22 which extend upwardly and inwardly and terminate in an anchor portion 23. Preferably, the length of the transverse member 21 is greater than that of the hanger 10 to receive a garment supported by the clamps 13. The length of the end portions 22 is such that the anchors 23 for securing the auxiliary bar to the hanger are located just inwardly of the clamps 13. The anchor portions are shaped to form a socket 24 defined by a pair of ears 25 which extend forwardly and terminate in vertically extending fingers which define a front opening which is less than the vertical height of the beam-like body 11. The auxiliary bar is molded of a plastic which has just enough resilience that the gap or opening between the ears 25 can be spread just enough to admit the beam-like body 11 of the hanger into the socket 24 where, because of this resilience, the beam will be clamped by the ears 25. Thus, the bar is detachably secured to the hanger and can be removed simply by spreading the ears to release it.

Figure 4:
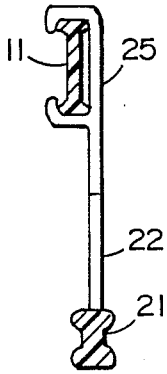
FIG. 4 is an enlarged, sectional elevational view taken along the plane IV—IV of FIG. 1.

It will be noted that the bar is so designed that it seats against the rear face of the hanger with the sockets 24 extending forwardly. As is shown in FIG. 4, the end portions are located in the same vertical plane as the back of the sockets 24. Thus, the auxiliary bar is located in a plane which is rearwardly of the garment receiving chamber 27 of the clamps 13. Thus, the presence of the bar 21 does not interfere with the use and function of the clamps. This is important because the bar is intended to be an auxiliary feature to support an additional object, such as another garment, without in any way interfering with the normal function of the clamps. For example, the bar could be used to drape a pair of slacks with the slacks being gripped by the clamps but the distance the slacks would hang down from the hanger could be reduced because they can be folded to drape over the bar.

Figure 3:
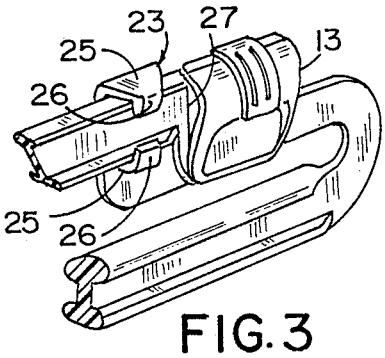
FIG. 3 is a fragmentary, oblique front view of the auxiliary bar secured to the hanger.
Figure 2:
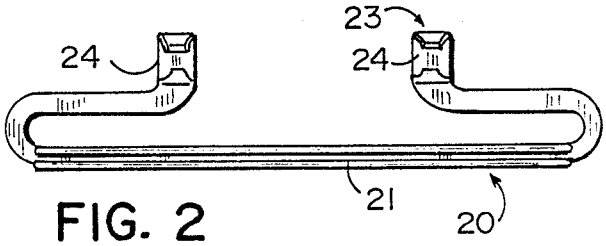
FIG. 2 is a front elevational view of the auxiliary bar of this invention.

By making the bar detachable, the bar need be used only when it is required. Further, by making the hanger and the bar as two entirely separate and independent products, the complexity of the necessary molds is substantially reduced. In fact, since the hangers have long since been widely used commercially, only the bar needs to be manufactured to effect this improvement. It will be recognized that the shape of the garment supporting portion of the auxiliary bar can be designed to satisfy any of a number of different requirements because its length and particular cross-sectional shape can vary as needed. The reversely bent end sections can be simple rectangles with their greater dimension extending vertically, as will be observed from inspection of FIG. 3.

Figure 5:
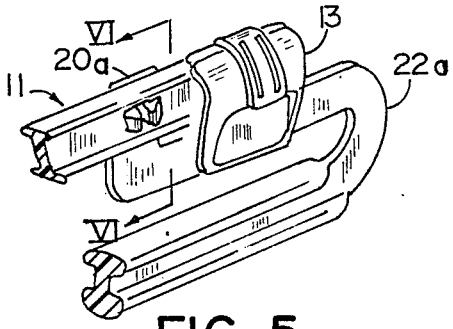
FIG. 5 is a fragmentary, oblique front view of a modified construction for the auxiliary bar.
Figure 6:
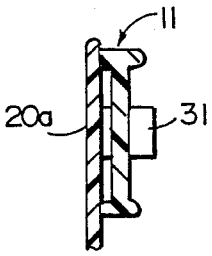
FIG. 6 is a sectional elevational view taken along the plane VI—VI of FIG. 5.
Figure 6A:
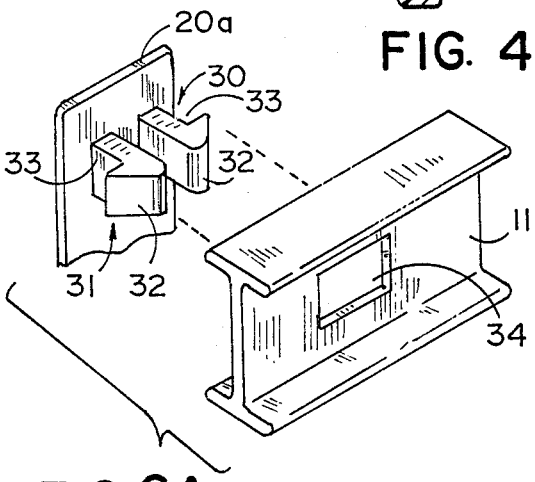
FIG. 6A is an enlarged, fragmentary, exploded view of the auxiliary bar construction illustrated in FIG. 5.

FIGS. 5, 6 and 6A illustrate a modification of the invention in which the sockets 24 are replaced by a pair of ears 30 and 31 with enlarged heads. The heads have oppositely facing, wedge-shaped portions 32 with an undercut 33 adjacent the forward face of the end portions **22*a* of the bar. These are designed to be pushed through an appropriate opening 34 in the vertical panel of the beam-like body 11 adjacent each of the clamps 13 (FIG. 6A). The ears are spaced sufficiently that they can be squeezed together just enough to be passed through the opening 34 and once through the opening, due to their resilience, they will separate to seat over the front face of the beam and, thus, lock the auxiliary bar 20*a* to the hanger body 11**.

When the hanger body has top and bottom flanges to provide rigidity and load support, the end of the auxiliary bar **20*a* is long enough to engage and seat against both the upper and lower flanges of the body (FIG. 6**). For this purpose, the base portions of the ears are lengthened to bridge the gap created by the auxiliary bar to seat against the flanges rather than the vertical web. This also has the beneficial effect of making the ears somewhat easier to push together when the auxiliary bar is to be attached or detached from the hanger.

Figure 9:
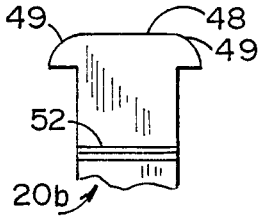
FIG. 9 is a fragmentary front view of the anchor end of the auxiliary bar illustrated in FIG. 7.

FIGS. 7–11 illustrate a different approach to the attachment of an auxiliary bar to a clamping hanger. In this case, the hanger has somewhat different garment clamps at each end. In this construction, the rear leg 40 of a pinch-clip type clamp 41 is integral with the beam or body **11*a* of the hanger and the front leg 42 is secured to it by a web which functions as a hinge so located that it is substantially spaced from both the upper and lower ends of the legs 40 and 42. The upper portions of the legs form a grip by which the legs can be manipulated to open and close the clamp. The legs are biased to resiliently grip a garment by means of a spring 44 in a manner long known in the garment hanger field. That portion of the clamps which extends above the web which serves as the hinge about which the legs pivot form handles 45 by which the clamps can be manipulated. In many cases, the handle portions of the clamps have central openings 46. In this type of construction, the auxiliary bar 20*b* has a upstanding end portion which terminates in a T-shaped head 48 (FIG. 9). The head provides a pair of laterally extending tabs or ears 49, creating a head wider than the opening 46 through the handle portion of the rear leg. Because of the resiliency of the material from which the end portion 47 of the auxiliary bar is made, these ears can be squeezed together enough to be passed through the opening and then allowed to resume their natural spacing, thus securing the auxiliary bar to the rear leg. An alternative to this in some cases could be turning the head 48 diagonally of the opening enough to pass the tabs through as suggested in FIG. 11**.

So that the lower portion of the reversely bent section 47 will lie closely against the back face of the rear leg, a score line or reduced thickness section 52 may be provided across the end portion just below the tabs to overcome any resilient stiffness which would tend to bias the lower portion of the auxiliary bar to project rearwardly.

Figure 7:
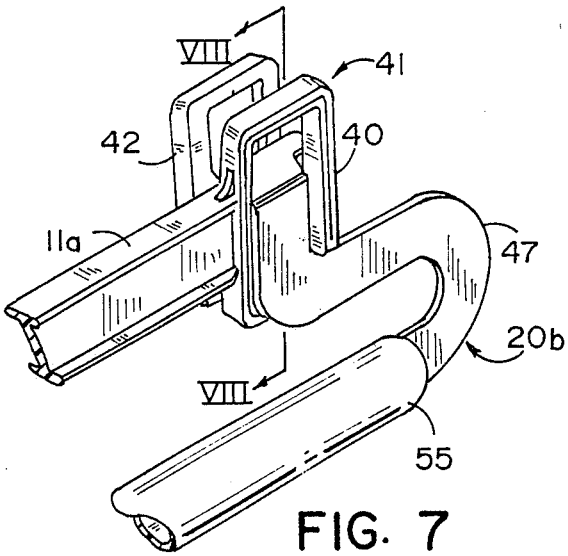
FIG. 7 is an enlarged, fragmentary view of a further modification of this invention with the bar anchored to the hanger.
Figure 8:
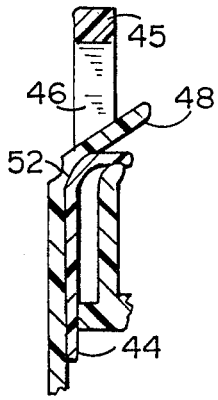
FIG. 8 is a fragmentary sectional view taken along the plane VIII—VIII of FIG. 7.
Figure 10:
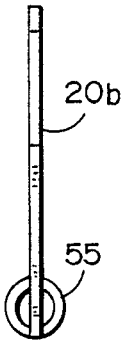
FIG. 10 is an end view of the auxiliary bar illustrated in FIG. 7.
Figure 12:
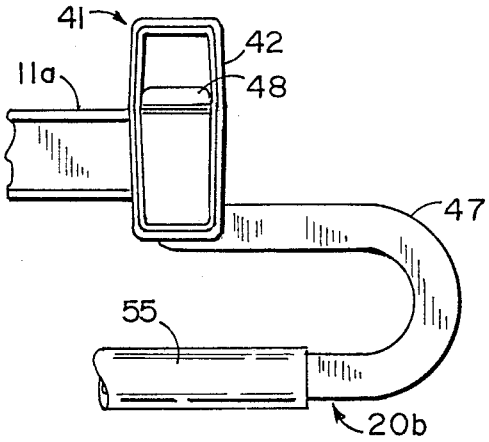
FIG. 12 is a fragmentary front view of a hanger with the auxiliary bar of FIG. 7 secured to it.
Figure 11:
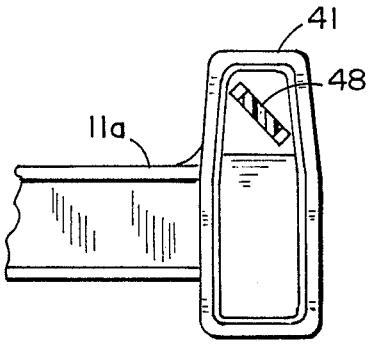
FIG. 11 is a fragmentary view illustrating one method of securing to the hanger the auxiliary bar illustrated in FIG. 7.

As is suggested in FIGS. 7, 10 and 12, the rear bar need not necessarily be made of a single integral molded item. The ends can be molded or stamped from plastic material and then inserted in the end of a tubular member with a bonded or an interference fit or both. The tubular member could be plastic or plastic reinforced paper and thereby provide the desired rigidity to support the article and also provide a broad enough supporting surface that whatever is draped over it will not be creased by reason of its weight resting on the auxiliary bar. As is illustrated in FIG. 11, the auxiliary bar does not materially interfere with the appearance of the hanger from the front because its attachment to the hanger is concealed behind the lower portion of the clamp as is indicated in FIG. 12.

It will be seen that the invention provides a relatively inexpensive, easy to use, auxiliary bar which may be added to existing garment hangers of the clamping type. Further, it can be attached or removed easily and quickly and requires no modification of existing hangers of the clamping types. Thus, it provides a relatively inexpensive way of expanding the utility and convenience of existing clamping hangers, when such is desired.

Having described a preferred embodiment of the invention, together with modifications thereof, it will be understood that other modifications of the invention can be made without departing from the principles of the invention. Such modifications are to be considered as included in the hereinafter appended claims unless these claims by their language expressly state otherwise.

I claim:

1. In combination an auxiliary garment support bar of molded plastic and a garment clamping hanger, said hanger having an elongated molded plastic body and support means therefor intermediate its ends, a pair of clamps, one on each side of said support means, said support bar having an elongated portion wider than the combined length of said body and clamps over which a garment can be draped, the end portions of said bar being shaped to extend upwardly and toward each other, said end portions being of rectangular cross-sectional shape and each having a greater dimension extending upwardly and generally parallel to the body of the hanger to support loads imposed on the support bar and the lesser dimension of said cross-sectional shape extending from front to back, permitting the end portions to seat against the rear face of the hanger body and the support bar to assume a position depending in a plane immediately behind the hanger body, the free ends of said end portions having anchor portions adapted to engage and be supported by said hanger body, said anchor portions being resiliently deflectable and having elements capable of interlocking with said hanger body.

2. The garment hanger and auxiliary garment support bar as described in claim 1 wherein said elements detachably interlock said hanger body.

3. The garment hanger and auxiliary garment support bar as described in claim 1 wherein said elongated support bar is a rigid bar having front and back faces and said anchor portions are resilient fingers shaped to form a socket of a size and shape to seat tightly over and clamp to said hanger body.

4. The garment hanger and auxiliary garment support bar as described in claim 2 wherein said fingers are shaped to form a C-shaped socket of a size to seat over and grip said hanger body.

5. The garment hanger and auxiliary garment support bar as described in claim 1 wherein said hanger body has a vertical panel, an opening through said panel adjacent each of said clamps, said elements being a pair of spaced ears integral with and extending forwardly from each said end portion, said ears having undercut portions adjacent their bases to receive and seat over the sides of a corresponding opening when said ears have been resiliently deflected toward each other and passed through said opening for detachably locking said support bar to said hanger body.

6. The garment hanger and auxiliary garment support bar as described in claim 1 wherein said clamps each have a pair of jaws one of which is integral and stationary with respect to said hanger body and the other is pivotably secured to said one jaw, said one jaw of each clamp being apertured, the ends of said anchor portions being provided with oppositely directed wings, said end portions being sufficiently resilient that said wings can be deflected to pass forwardly through said apertures and upon release seat against the front face of said hanger body on each side of the apertures to detachably secure the support bar to the hanger body.

7. An auxiliary garment support bar adapted to be detachably mounted on a garment hanger having a beam forming an elongated body with a garment clamp at each end, support means intermediate the ends of the body, said body being characterized by a vertical web, said body having an opening therethrough adjacent each of said clamps, said support bar having an elongated central portion and a pair of ends reversely curved in an upward direction, the terminal portion of each of said ends having a pair of spaced ears, said ears each having an undercut portion adjacent its base, said ears being resiliently deflectable toward each other to be passed through one of said openings in said web.

8. In combination, a garment hanger and a detachable auxiliary garment support bar depending therefrom, said hanger having a beam forming an elongated body with support means intermediate its ends, said body having a rigid vertical web and an article clamp on each end thereof; each of said clamps having a rear jaw and a front jaw, said jaws being pivotally joined with said rear jaw being integral with and supported in the same vertical plane as said body, said support bar having an elongated rigid central portion over which a garment can be draped and a pair of end portions, said end portions extending upwardly and toward each other, said body having an aperture adjacent each of said clamps, said end portions each having forwardly extending ears capable of being passed forwardly through one of said apertures, said ears seating against the forward face of said body and resiliently locking the support bar to said body.

9. In combination, a garment hanger and a detachable auxiliary garment support bar depending therefrom, said hanger having a beam forming an elongated body with support means intermediate its ends, said body having a rigid vertical web and an article clamp on each end thereof; each of said clamps having a rear jaw and a front jaw, said jaws being pivotally joined with said rear jaw being integral with and supported in the same vertical plane of said body, said support bar having an elongated rigid central portion over which a garment can be draped and a pair of end portions, said end portions extending upwardly and toward each other, said clamp having upwardly extending finger grips above the joinder thereof for maintaining the jaws, the finger grip of said rear jaw having an aperture therethrough, the terminal portion of each of said end portions of said support bar extending through said aperture into the space between said finger grips, said terminal portions each having oppositely and outwardly extending ears adapted to seat against the forward face of said finger grip of said rear jaw for detachably securing said auxiliary bar to said hanger.

10. The combination described in claim 9 wherein said terminal portions are sufficiently resilient to be deflected to pass through said apertures.

11. The combination described in claim 9 wherein said terminal portions below said ears have a line of reduced thickness extending thereacross serving as a hinge to permit the remainder of the auxiliary support bar to depend from said terminal portions in a plane immediately behind said beam.

* * * * *